US007409805B1

(12) United States Patent
Keisling, Jr.

(10) Patent No.: US 7,409,805 B1
(45) Date of Patent: Aug. 12, 2008

(54) LOCKER RETROFIT ASSEMBLY

(75) Inventor: Delbert P. Keisling, Jr., Clarks Summit, PA (US)

(73) Assignee: Scranton Products Inc., Scranton, PA (US)

( * ) Notice: Subject to any disclaimer, the term of this patent is extended or adjusted under 35 U.S.C. 154(b) by 704 days.

(21) Appl. No.: 10/821,364

(22) Filed: Apr. 9, 2004

(51) Int. Cl.
*A47B 47/00* (2006.01)
*E06B 5/00* (2006.01)

(52) U.S. Cl. ..... 52/741.1; 52/745.01; 52/514; 52/745.15

(58) Field of Classification Search ..... 52/204.1, 52/514, 656.4, 210–213, 745.05, 745.09, 52/745.1, 745.13, 745.15, 745.16; 16/390, 16/392; 312/109, 111, 326, 119, 259, 329; 24/71 R, 136 R, 578.1, 615; 224/578
See application file for complete search history.

(56) References Cited

U.S. PATENT DOCUMENTS 3,853,367 A * 12/1974 Jamison et al. ..... 312/259
5,372,415 A * 12/1994 Tisbo et al. ..... 312/108
5,564,806 A 10/1996 Keisling et al. ..... 312/263
5,595,426 A 1/1997 Wolff et al. ..... 312/109
5,810,458 A 9/1998 Wolff et al. ..... 312/109
5,951,126 A 9/1999 Wolff et al. ..... 312/199

* cited by examiner

*Primary Examiner*—Robert Canfield
*Assistant Examiner*—Bryan Eppes
(74) *Attorney, Agent, or Firm*—Buchanan Ingersoll & Rooney PC

(57) ABSTRACT

The present invention is a locker retrofit assembly which may be adapted for replacing the door and frame components of an existing locker system. An exemplary embodiment of the locker retrofit assembly may be comprised of plastic components for replacing the metallic components of the existing locker system. The locker retrofit assembly may be wholly or partially assembled off-site to facilitate expeditious installation on the existing locker system.

7 Claims, 3 Drawing Sheets

LOCKER RETROFIT ASSEMBLY

BACKGROUND AND SUMMARY OF THE INVENTION

The present invention relates generally to lockers and, more particularly, to locker retrofit assemblies. The present invention is designed as a replacement for existing locker assemblies, which may include one or more components of a locker. For instance, the present invention may be used to replace existing locker doors, frames, panels, combinations of these locker components, or other locker components.

Lockers for storing clothing, articles of merchandise, etc., are commonly constructed. Storage lockers are found in many different settings. For example, athletic facilities have lockers to allow athletes to store their possessions while participating in athletic events. Community swimming pools typically have lockers for storing street clothes while a person swims. Lockers are also found in industry where they are used for several purposes, such as the storage of equipment, work clothes, chemicals, and other items that are preferably kept in a concealed environment when not in use. Lockers are also commonly found in airports, hospitals, school hallways, prisons, and many other sites too numerous to mention.

Steel sheet metal and metal fasteners are common construction materials used to make locker assemblies. However, metallic lockers suffer from several disadvantages. They are easily damaged or marred such as by dents, scratches, and graffiti. Moreover, metal is subject to damage from rust, odors, delamination, chipping, and fading.

Attempts have been made to solve the above-mentioned problems by wholly replacing these metallic lockers with plastic or wood lockers. Some storage lockers were built into either an existing wall of a building or into a building wall while under construction. These in-wall lockers may be expensive to replace with plastic lockers. These problems prevent many from taking advantage of the properties that plastic offers over steel sheet metal. Consequently, a need exists for a locker retrofit assembly that is designed to overcome the aforementioned disadvantages.

The present invention is a locker retrofit assembly. An exemplary embodiment of the locker retrofit assembly may be comprised of a material designed to overcome one or more of the above disadvantages, such as a plastic material. However, it must be understood that any material, not limited to non-metal material, that exhibits the desired structural characteristics may be utilized for the present invention. For example, in some embodiments of the present invention, the locker retrofit assembly of the present invention may be comprised of the same material, e.g., metal, as the existing locker assembly.

In one embodiment of the present invention, existing metallic doors, frames, and panels may be replaced with a plastic locker retrofit assembly. Due to the plastic construction of this embodiment of the retrofit door assembly, the locker face may be more resistant to many forms of abuse that lockers commonly receive. For instance, the locker doors may not dent as will metal lockers. In one embodiment, the locker door of the present invention may also maintain its color throughout its entire cross-section. Due to the homogeneous nature of the plastic door of this embodiment of the assembly, the lockers of the present invention may not delaminate. Furthermore, many materials used in the application of graffiti may be removed from plastic panels to return the locker doors to their original surface appearance. The remaining metallic body of the existing locker system may be substantially hidden behind the face (e.g., the door and frame of the retrofit assembly) and is thus protected. Moreover, the substitution of a plastic retrofit assembly may provide many cosmetic and aesthetically pleasing attributes to the locker system. The retrofit assembly may carry almost any desirable color scheme. Colors may be chosen to match the surrounding decor, to provide a color coding scheme, and/or to provide a medium for an organizational theme.

Additionally, the present invention may provide a retrofit locker assembly which may be assembled off-site. The retrofit assembly may be shipped as one complete part or multiple parts that may be expeditiously attached to the old locker frame on-site. Accordingly, the locker assembly may be manufactured and assembled in a quality controlled factory environment which results in high quality, structurally sound, and consistent assemblies. Accordingly, the locker assemblies of the present invention may be installed on-site in a relatively short time while maintaining structural integrity and consistency.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

The present invention is directed to a locker retrofit assembly. The locker retrofit assembly may be installed on an in-wall locker system. It should also be recognized that the locker retrofit assembly may be installed on other types of locker assemblies such as freestanding locker assemblies or locker assemblies that are installed on the outside of a wall or other structure. The following description and accompanying figures disclose a locker retrofit assembly with a right-hand opening. Nevertheless, it must be understood that the present invention also encompasses left-hand, top, bottom, or other openings and that the knowledge to provide such openings would be readily apparent from the disclosure provided herein. Although existing metal lockers are well suited for retrofit with the present invention, lockers made of other materials would likewise benefit from the present invention.

Figure 1:
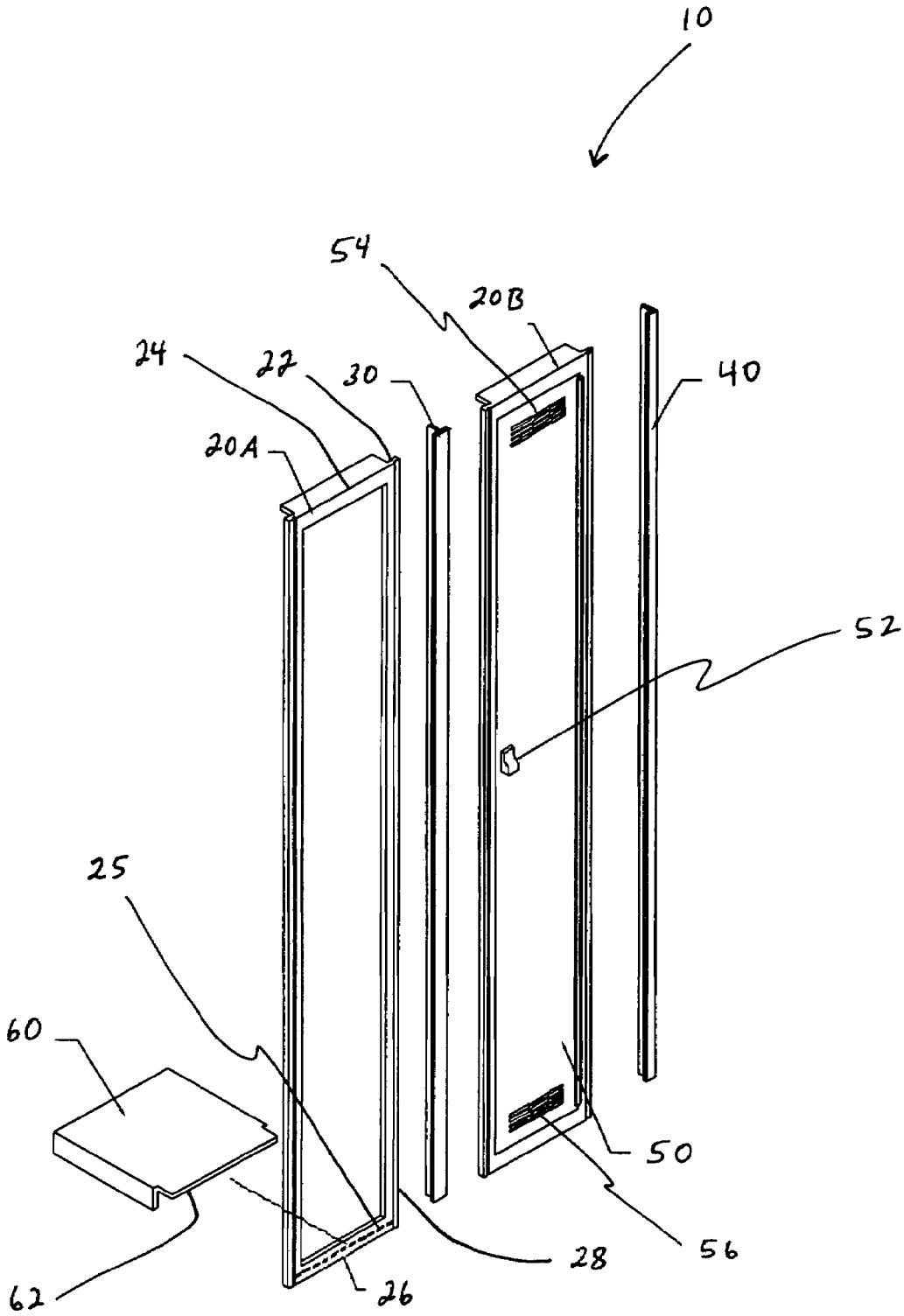
FIG. 1 is a fragmentary, perspective view of an exemplary embodiment of a locker retrofit assembly of the present invention.

FIG. 1 shows an exemplary embodiment of a locker retrofit assembly 10 of the present invention. The locker retrofit assembly 10 may be comprised of at least one frame and at least one jamb. In this exemplary embodiment, the locker retrofit assembly is comprised of a frame 20A, a frame 20B, a jamb 30, and a jamb 40. Optionally, the locker retrofit assembly may include other components such as a door 50 and a bottom panel 60.

Frame 20A and frame 20B may be substantially similar. Each frame may be adapted to extend at least partially around and substantially fit with a respective opening of an existing locker assembly. An edge portion of a frame is adapted to be connected to a jamb. For example, a longitudinal edge portion 22 of frame 20A is adapted to be connected to jamb 30. Likewise, the other longitudinal edge portion may be adapted to be connected to another jamb. Optionally, each frame may also have at least one bent edge. In this example, the frame 20A has a top bent edge 24. Optionally, the frame 20A may also have a bottom bent edge 26. A bent edge portion may facilitate attachment to an existing locker assembly.

Figure 2:
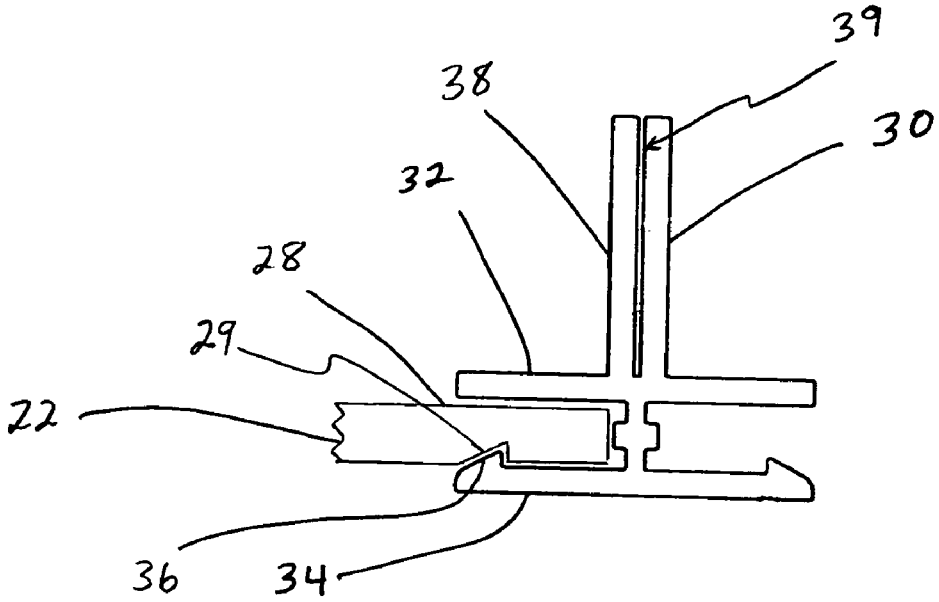
FIG. 2 is a partial, plan view of an exemplary embodiment of an intermediate jamb profile of the present invention that is connected to an exemplary edge portion of a frame of the present invention.

FIG. 2 shows an exemplary connection between the edge portion 22 of frame 20A and the jamb component 30. In this example, the jamb component 30 comprises a prong 32 and a prong 34. The edge portion 22 of frame 20A forms a tongue 28. The tongue 28 may be situated between prong 32 and prong 34 in order to connect the frame 20A to jamb 30. FIG. 2 shows one example in which the frame 20A and the jamb 30 may be snapped together. In this exemplary embodiment, the tongue 28 has an angled edge portion 29 that is engaged with an angled edge portion 36 of prong 34. Each of the angled edge portions may have any suitable shape for facilitating the desired engagement. In this example, the angled edge portion 29 defines a groove, and the angled edge portion 36 defines a protrusion. In other embodiments, the angled edge portion 29 may define a protrusion, and the angled edge portion 36 may define a groove. If desired, the angled edge portions may engage each other such that the frame 20A is interlocked with the jamb 30. FIG. 2 shows one example of an interlocking engagement between a frame and a jamb. Based on the teaching provided herein, it should be recognized that other types of interlocking connections may be utilized in the present invention.

Jamb 30 is an example of an intermediate connector. In this example, jamb 30 is adapted to connect frame 20A to frame 20B. Accordingly, the jamb 30 includes another pair of prongs that may facilitate a similar type of connection with a longitudinal edge portion of frame 20B.

A base portion 38 of jamb 30 may facilitate connection to an existing locker assembly. In this exemplary embodiment, the base portion 38 defines a slit or gap 39. The slit 39 may receive or otherwise facilitate a connection to a wall panel of the existing locker assembly. Optionally, mechanical fasteners and/or adhesives may be used to secure the base portion 38 (with or without slit 39) to a wall panel of the existing locker assembly.

Figure 3:
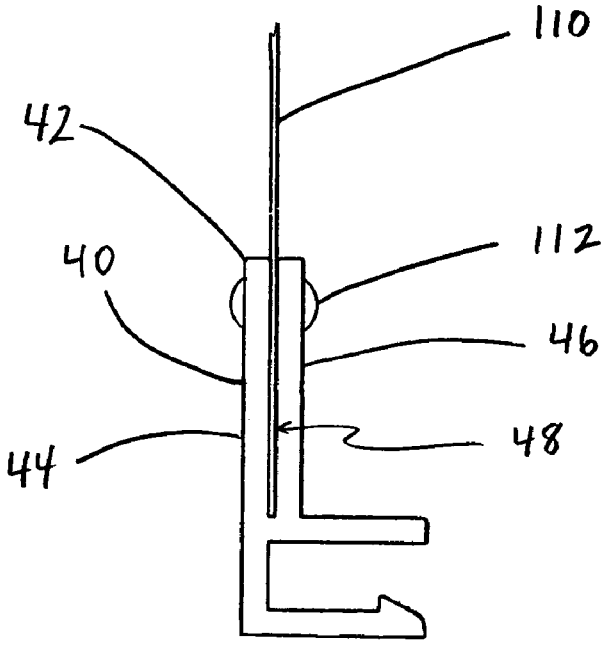
FIG. 3 is a partial, plan view of an exemplary embodiment of an end jamb profile of the present invention that is connected to an exemplary side panel of an existing locker.

FIG. 3 shows an example of an end jamb 40. An end jamb 40 may be used to end a run of the retrofit locker assembly. In this example, the jamb 40 is substantially similar to the jamb 30, with the primary exception being that it only includes one pair of prongs for connecting to frame 20B. Although not shown, another jamb 40 may be connected to the other longitudinal edge portion of frame 20A if additional frames are not included in the locker retrofit assembly.

FIG. 3 also shows an example of how a jamb may be connected to an existing locker. In this example, the base portion 42 of jamb 40 is comprised of a portion 44 and a portion 46. A slit or gap 48 is defined between portion 44 and portion 46. A side panel 110 of the existing locker box is adapted to slide into the slit or gap 48 during installation of the locker retrofit assembly. Optionally, a fastener 112 may be used to secure the jamb 40 to the panel 110. Adhesives, an interlocking mechanism, or any other suitable means may also be used to attach the jamb to the existing locker system.

In this exemplary embodiment, jamb 30 and jamb 40 are profiles. The profiles may be made by extrusion or any other suitable manufacturing method. However, it should be recognized that the jambs may not be profiles in some embodiments of the present invention.

Optionally, the locker retrofit assembly 10 may include at least one door 50 such as shown in FIG. 1. The door 50 may be pivotally connected to the frame 20B and/or jamb 40 in this example. For instance, a hinge component may pivotally connect the door 50 to the frame 20B and/or jamb 40. The door 50 may include a latch assembly 52. An exemplary embodiment of the latch assembly may be slidably adjustable. U.S. Pat. No. 5,564,806, U.S. Pat. No. 5,595,426, U.S. Pat. No. 5,810,458, and U.S. Pat. No. 5,951,126 teach examples of door hinge, door latch, door lock, and door handle assemblies that may be adapted for use with the present invention. The door 50 may also include at least one perforated portion. In this particular embodiment, the door 50 includes a perforated portion 54 and a perforated portion 56. The perforated portions 54 and 56 may be punched, molded, or made in any other suitable manner in the door 50.

The locker retrofit assembly 10 may also include a bottom panel 60. The bottom panel 60 may have any configuration that is suitable for replacing the existing bottom panel. For example, the bottom panel 60 may include one or more bent edges such as shown in FIG. 1. Also, the bottom panel 60 may define a tongue 62. The tongue 62 may have any configuration that enables the bottom panel 60 to be connected to the frame 20A. In this example, the frame 20A may include a groove 25 that is adapted to receive the tongue 62 of bottom panel 60 when assembled. Optionally, the tongue in some embodiments of the present invention may rest on a bottom bent edge of the frame.

Figure 4:
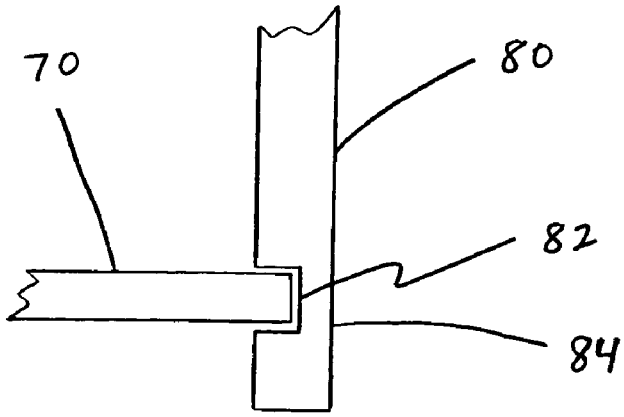
FIG. 4 is a partial, side elevation view of an exemplary embodiment of a bottom panel of the present invention situated in an exemplary groove of a frame of the present invention.
Figure 5:
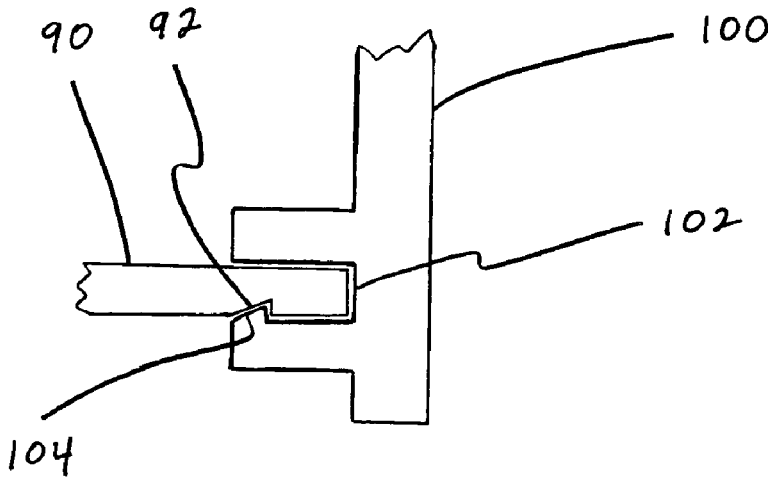
FIG. 5 is a partial, side elevation view of another exemplary embodiment of a bottom panel of the present invention situated in another exemplary groove of a frame of the present invention.

The bottom panel may be connected to the frame in numerous ways. FIG. 4 shows an example in which a tongue 70 is situated in a groove 82 in a bottom edge portion 84 of a frame 80. In another exemplary embodiment shown in FIG. 5, a tongue 90 is situated in a groove 102 of a frame 100. Such as shown in this example, the tongue 90 may include an angled edge portion 92. The groove 102 may also have an angled edge portion 104 that facilitates interlocking engagement with the tongue 90. Although specific examples have been provided, it should be recognized that a bottom panel may be connected to or interlocked with a frame in various other ways in the present invention.

Although not shown, the locker retrofit assembly may include other components. For example, the locker retrofit assembly may include trim components at the top and bottom of the frame assembly. The trim may serve to cosmetically and mechanically smooth the transition from the locker retrofit assembly to a building wall. Fasteners such as countersunk screws may be used to secure the trim components, but any method of fastening a trim component may be used.

An exemplary embodiment of the present invention may be used to give an existing locker a new face. It is desirable to have a retrofit locker assembly which may be expeditiously connected, on-site, to an existing locker system. In an exemplary embodiment of the present invention, the door and outer frame components of the existing locker system may be removed, leaving the inner box of the existing locker system. The bottom panel of the existing locker system may also be removed if rusted or damaged. The locker retrofit assembly of the present invention may then be installed on the remaining box of the existing locker system. However, in some alternative embodiments, the locker retrofit assembly may be installed on the existing locker system without removing some or all of the existing outer frame components. For example, the components of the locker retrofit assembly may cover, enclose, or otherwise be secured to the outer frame of the existing locker system.

An exemplary embodiment of the locker retrofit assembly may be attached to an existing locker system as one unit or as multiple units. For example, the components may be pre-assembled at a remote site (e.g., an off-site plant) and then be transferred to the site of the existing locker system for installation as a single unit or multiple units. This method preferably reduces the time it takes for assembly of the locker assembly on-site. Additionally, constructing the retrofit locker assembly in a factory environment preferably allows for a quality-controlled assembly which results in a high quality, consistent, construction. Nevertheless, it should be recognized that the locker retrofit assembly of the present invention may be assembled and installed on-site without any pre-assembly.

The components of the retrofit locker assembly may be formed from any suitable material. In one exemplary embodiment, the components of the assembly may be formed from a durable, non-metallic, material such as plastic or any other suitable material. However, in another embodiment of the present invention, some or all of the components may be made from metal. The components may be made of the same or different materials. In one example, the jamb components may be made from a polyvinyl chloride (PVC) material, and the frame, door, and bottom panel components may be made from a high density polyethylene (HDPE) material. In addition, the components may be the same color or different colors. In one exemplary embodiment, the frame may be black, and the door may be a different color.

An exemplary method of constructing the locker retrofit assembly may include some or all of the following steps:

1) fabricating and cutting the frames and door panels from at least one sheet of high impact, high density polyethylene material of desired thickness (e.g., about 0.5-inch thick);
2) forming the bottom panels from at least one sheet of high impact, high density polyethylene material of desired thickness (e.g., about 0.375-inch thick);
3) extruding or molding the jambs from a polyvinyl chloride material;
4) bending the edges of the frames and bottom panels as appropriate;
5) attaching the doors to the frames and/or jambs;
6) snapping the frames and jambs together to form a single unit or multiple units;
7) delivering the unit(s) to the site of the existing locker system for attachment to the existing locker frame;
8) replacing the existing bottom panels with the retrofit bottom panels; and
9) attaching the frame and jamb unit(s) to the existing locker to replace the existing jambs and frames.

It should be recognized that the order of the steps may be changed without departing from the scope of the present invention. A CNC machine or machines may be used to perform the cutting and bending operations. The sheets from which the frames are made may be extruded or molded in order to form the grooves. Alternatively, the grooves may be formed in a subsequent step such as by machining or in a remolding process. As set forth in the steps, the locker retrofit assembly may be installed as a single unit or as multiple units that are joined upon installation on the existing locker system. For example, each assembly of a frame, door, and jamb may be a separate unit prior to installation on the existing locker system.

It should be recognized that the locker retrofit assemblies of the present invention may be sized to retrofit existing locker assemblies of various dimensions. It should also be recognized that the locker retrofit assembly of the present invention may be comprised of different combinations of the aforementioned components. For example, one embodiment of the present invention may be comprised of a frame and a jamb. Another embodiment of the present invention may be comprised of a frame and a bottom panel. Still another embodiment of the present invention may be comprised of a frame and a door. Yet another embodiment of the present invention is comprised of a frame, a jamb, a bottom panel, and a door. Therefore, although specific examples have been described, it is not intended to limit the present invention to a particular combination of components or to components of specific dimensions unless expressly stated.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method for retrofitting an existing locker assembly having a door opening, said method comprising:

removing an existing frame and an existing jamb of said existing locker assembly;

providing a frame fitted fit with said door opening of said existing locker assembly, the frame comprising a longitudinal edge portion that defines a tongue;

providing a jamb, comprising first and second prongs and a base portion, adapted to be secured to said existing locker assembly;

joining said jamb and said frame, the tongue of the frame being situated between the first and second prongs after this joining; and securing said jamb with the base portion to said existing locker assembly.

2. The method of claim 1 wherein said jamb and said frame are joined by being snapped together.

3. The method of claim 1 further comprising:

removing an existing bottom panel of said existing locker assembly; and replacing said existing bottom panel with a bottom panel having an edge portion defining a tongue;

wherein said tongue is situated in a groove in a bottom edge portion of said frame when said jamb is secured to said existing locker assembly.

4. The method of claim 1 further comprising:

removing an existing door of said existing locker assembly;

providing a door adapted to fit with an opening in said frame; and forming a unitary assembly comprised of said frame, said jamb, and said door prior to securing said jamb to said existing locker assembly.

5. A method for retrofitting an existing locker assembly having a door opening, said method comprising:

removing an existing frame, existing jamb, and existing bottom panel of said existing locker assembly;

providing a frame adapted to fit with said door opening of said existing locker assembly;

providing a jamb adapted to be secured to said existing locker assembly;

replacing said existing bottom panel with a bottom panel having an edge portion defining a tongue, wherein said tongue is situated in a groove in a bottom edge portion of said frame when said jamb is secured to said existing locker assembly;

joining said jamb and said frame; and securing said jamb to said existing locker assembly.

6. The method of claim 5 wherein said jamb and said frame are joined by being snapped together.

7. The method of claim 5 further comprising:

removing an existing door of said existing locker assembly;

providing a door adapted to fit within an opening in said frame; and forming a unitary assembly comprised of said frame, said jamb, and said door prior to securing said jamb to said existing locker assembly.

* * * * *

UNITED STATES PATENT AND TRADEMARK OFFICE

CERTIFICATE OF CORRECTION

PATENT NO. : 7,409,805 B1
APPLICATION NO. : 10/821364
DATED : August 12, 2008
INVENTOR(S) : Delbert P. Keisling, Jr.

It is certified that error appears in the above-identified patent and that said Letters Patent is hereby corrected as shown below:

At column 6, claim 1, line 41, delete "fit"

Signed and Sealed this

Seventeenth Day of March, 2009

JOHN DOLL
*Acting Director of the United States Patent and Trademark Office*